United States Patent [19]

Bandukwalla et al.

[11] 4,257,733

[45] Mar. 24, 1981

[54] DIFFUSER CONTROL

[75] Inventors: Phiroze Bandukwalla, N. Syracuse; Gordon L. Mount, W. Monroe; Howard W. Kirtland, N. Syracuse, all of N.Y.

[73] Assignee: Carrier Corporation, Syracuse, N.Y.

[21] Appl. No.: 973,404

[22] Filed: Dec. 26, 1978

[51] Int. Cl.[3] ..... F04D 27/00

[52] U.S. Cl. ..... 415/13; 415/150; 415/158

[58] Field of Search ..... 415/26, 46, 47, 48, 415/49, 148, 150, 157, 158, 13

[56] References Cited

U.S. PATENT DOCUMENTS

| | | | |
|---|---|---|---|
| 916,427 | 3/1909 | Fee | 415/26 |
| 2,957,424 | 10/1960 | Brundage | 415/48 |
| 3,032,259 | 5/1962 | Jassniker | 415/148 |
| 3,251,539 | 5/1966 | Wolfe et al. | 415/158 X |
| 3,289,919 | 12/1966 | Wood | 415/158 X |
| 3,362,624 | 1/1968 | Endress | 415/49 X |
| 3,362,625 | 1/1968 | Endress | 415/149 R |
| 3,365,120 | 1/1968 | Jassniker | 415/26 |
| 3,399,625 | 9/1968 | Skinner | 415/47 |
| 3,619,078 | 11/1971 | Mount et al. | 415/150 |
| 3,667,860 | 6/1972 | Endress et al. | 415/150 |
| 4,070,132 | 1/1978 | Lynch | 415/48 |

FOREIGN PATENT DOCUMENTS

| | | | |
|---|---|---|---|
| 305214 | 7/1930 | United Kingdom | 415/158 |
| 1445016 | 8/1976 | United Kingdom | 415/148 |

*Primary Examiner*—Leonard E. Smith

*Attorney, Agent, or Firm*—J. Raymond Curtin; John S. Sensny

[57] ABSTRACT

A diffuser control for controlling vapor flow through a diffuser passage comprising an annular recess defined by a housing of the diffuser passage and in communication therewith, and an annular control ring supported for movement within the recess and the diffuser passage between a throttling position, wherein the restriction means throttles vapor flow through the diffuser passage, and an open position for permitting a substantially free flow of vapor through the diffuser passage. The diffuser control further comprises a plurality of springs supported by the housing for urging the control ring toward the throttling position, a stop for limiting movement of the control ring at the throttling position, a low pressure conduit for connecting the annular recess to a low pressure source, and a seal for retarding vapor flow from a higher pressure side of the control ring to a lower pressure side thereof when the control ring is in the open position. A valve is provided for regulating vapor flow through the low pressure conduit and includes a first position for maintaining a low pressure in the annular recess and a pressure difference across the control ring for maintaining the control ring in the open position, and a second position for maintaining a high pressure in the annular recess wherein the springs maintain the control ring in the throttling position.

7 Claims, 1 Drawing Figure

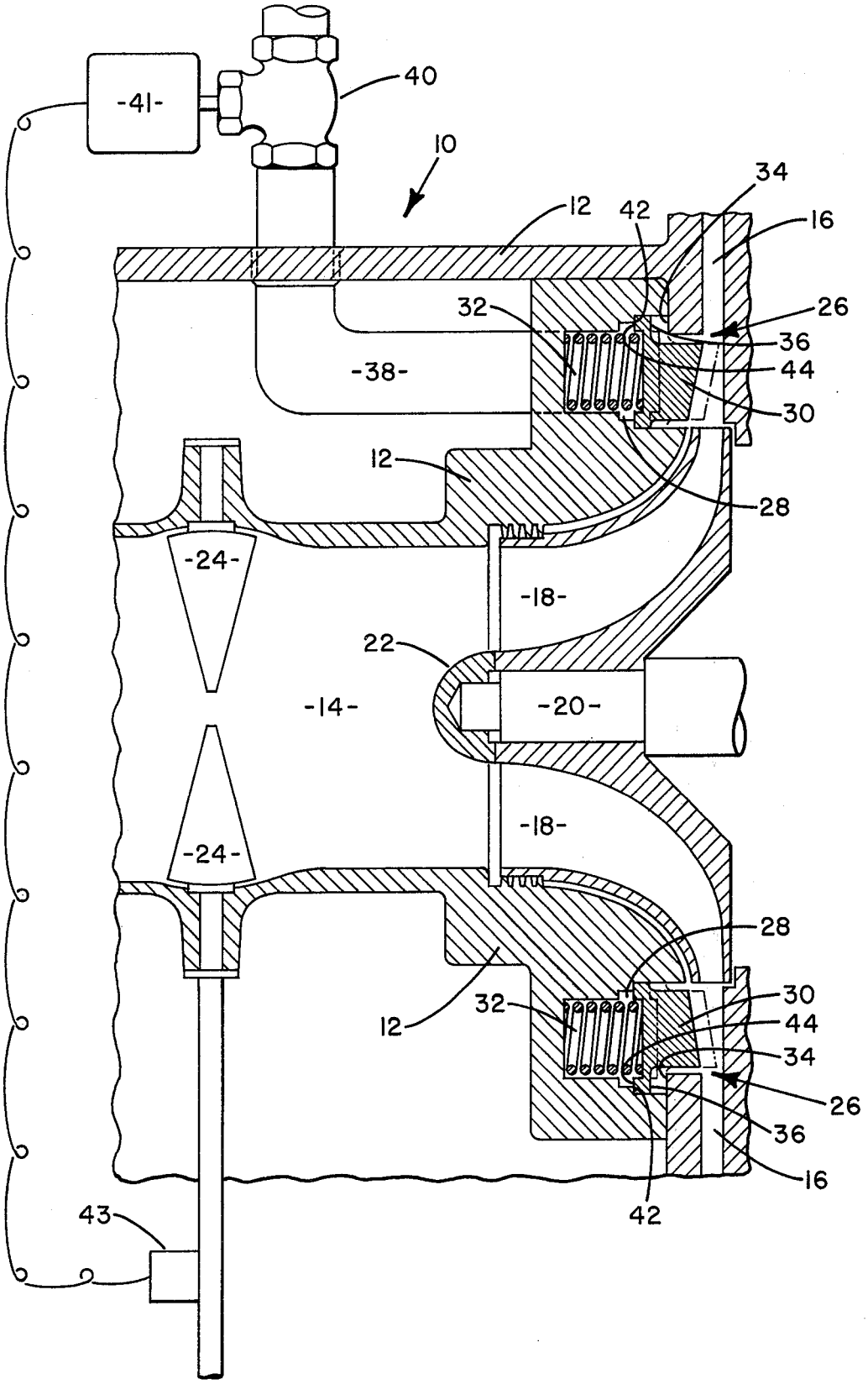
-41-
40
10
12
42
34
16
32
26
36
-38-
44
30
12
28
-24-
-18-
22
-14-
-20-
-18-
-24-
28
30
32
44
12
34
26
36
16
42
43

DIFFUSER CONTROL

BACKGROUND OF THE INVENTION

This invention relates to centrifugal vapor compressors, and more particularly to a diffuser control for controlling vapor flow through a diffuser passage of a centrifugal vapor compressor.

One of the major problems arising in the use of centrifugal vapor compressors for applications where the compressor load varies over a wide range is flow stabilization through the compressor. The compressor inlet, impeller and diffuser passages must be sized to provide for the maximum volumetric flow rate desired. When there is a low volumetric flow rate through such a compressor, the flow becomes unstable. As the volumetric flow rate is decreased from a stable range, a range of slightly unstable flow is entered. In this range, there appears to be a partial reversal of flow in the diffuser passage, creating noises and lowering the compressor efficiency. Below this range, the compressor enters what is known as surge, wherein there are periodic complete flow reversals in the diffuser passage, destroying the efficiency of the machine and endangering the integrity of the machine elements. Since a wide range of volumetric flow rates is desirable in many compressor applications, numerous modifications have been suggested to improve flow stability at low volumetric flow rates.

One of the most accepted and successful modifications has been the addition of guide vanes in the inlet of the compressor to vary the flow direction and quantity of entering vapor. Another widely known modification has been to vary diffuser configuration in response to the load on the compressor. Commonly, this is done by means of a diffuser control ring which moves laterally across the diffuser passage to throttle vapor flow therethrough. Prior art variable diffuser control rings have been generally controlled by a mechanism arranged to locate and hold the control ring at any position between a full opened and a full closed position. Such control mechanisms are typically relatively expensive, often involving fairly complex mechanical and/or pneumatic components. Further, because of the complex components, the manufacture and installation of diffuser ring control mechanisms are often difficult and time consuming tasks requiring expensive skilled manual labor. While continuously variable diffuser control rings often provide excellent results, it has been learned that very satisfactory results can be achieved with a diffuser control ring which has a limited number of discrete, spaced throttling positions. While obtaining these very satisfactory results, a discretely variable diffuser control, in accordance with the present invention, is, at the same time, much simpler than prior art diffuser controls. This simplicity facilitates and reduces the cost of construction, installation, and maintenance of the diffuser control and improves the reliability thereof.

SUMMARY OF THE INVENTION

An object of this invention is to improve centrifugal vapor compressors, particularly diffuser controls thereof.

Another object of the present invention is to simplify the manufacture and installation of diffuser controls.

A further object of this invention is to provide a two position diffuser control.

A still further object of the present invention is to use compressor inlet pressure to maintain a diffuser control ring in an open position.

Another object of this invention is to vary a diffuser control of a centrifugal vapor compressor in response to position of inlet guide vanes thereof.

These and other objectives are attained with a diffuser control for controlling vapor flow through a diffuser passage comprising an annular recess defined by a housing of the diffuser passage and in communication therewith, and diffuser restriction means supported for movement within the recess and the diffuser passage between a throttling position, wherein the restriction means throttles vapor flow through the diffuser passage, and an open position for permitting a substantially free flow of vapor through the diffuser passage. The diffuser control further comprises urging means supported by the housing for urging the restriction means toward the throttling position, first stop means for limiting movement of the restriction means at the throttling position, a low pressure conduit for connecting the annular recess to a low pressure source, and sealing means for retarding vapor flow from a higher pressure side of the diffuser restriction means to a lower pressure side thereof when the restriction means is in the open position. Valve means is provided for regulating vapor flow through the low pressure conduit and includes a first position for maintaining a low pressure in the annular recess and a pressure difference across the diffuser restriction means for maintaining the restriction means in the open position, and a second position for maintaining a high pressure in the annular recess wherein the urging means maintains the restriction means in the throttling position.

A BRIEF DESCRIPTION OF THE DRAWING

The sole FIGURE is an elevational view, partly in section of a portion of a centrifugal compressor incorporating the teachings of the present invention.

A DETAILED DESCRIPTION OF THE PREFERRED EMBODIMENT

Referring generally to the drawing, there is shown portions of vapor compressor 10 of the well-known centrifugal type wherein vapor to be compressed is induced to flow in and axial direction into a vaned impeller connected to a suitable driver for imparting rotary motion thereto. As the vapor is compressed during its travel through the compressor, it is directed radially from the impeller to a diffuser passage communicating with the tip of the impeller. More particularly, compressor 10 includes housing 12 with inlet passage 14 and diffuser passage 16 formed therein. Only portions of housing 12 are shown, it being understood that such a construction is conventional in equipment of the kind under consideration. Impeller 18 affixed to shaft 20 by nut 22 is provided in housing 12 between inlet passage 14 and diffuser passage 16. Inlet guide vanes 24 journaled for rotation in housing 12 are positioned about inlet passage 14 to control the direction and quantity of vapor flow therethrough. Diffuser control, referenced generally as 26, is provided for controlling vapor flow through diffuser passage 16.

Diffuser control 26 comprises, generally, annular recess 28 defined by housing 12 and in communication with diffuser passage 16, and diffuser restriction means such as annular control ring 30. Control ring 30 is supported for movement within annular recess 28 and diffuser passage 16 between an open position, shown in full lines in the drawing, and a throttling position, shown in broken lines in the drawing. In the throttling position, control ring 30 throttles vapor flow through diffuser passage 16; and, preferably, in the open position, the control ring allows an unrestricted flow of vapor through the diffuser passage. Urging means 32 is provided for urging control ring 30 toward the throttling position. Preferably, the urging means includes resilient means such as a plurality of springs 32 positioned within recess 28. Springs 32 are preferably equally spaced about the circumference of control ring 30, forming a ring of springs with a radius equal to the radius of the control ring. Stop means 34 limits movement of the control ring at the throttling position for preventing the control ring from completely restricting vapor flow through diffuser passage 16. Preferably stop means 34 includes a surface of housing 12. More specifically, as control ring 30 moves forward, from left to right as viewed in the drawing, and reaches the throttling position, flange 36 of the control ring abuttingly engages surface 34 and this abutting contact prevents further forward movement of the control ring.

Diffuser control 26 further comprises low pressure conduit 38 for connecting annular recess 28 to a low pressure source, for example an inlet line of compressor 10, and valve means 40 for regulating vapor flow through conduit 38. Valve 40 includes a first postion, preferably wherein conduit 38 is fully open, for maintaining a low pressure in annular recess 28 and a pressure difference across control ring 30 for maintaining the control ring in the open position. That is, the low pressure source is chosen so that the forces on control ring 30 resulting from the pressure differential thereacross, explained in greater detail below, when conduit 38 is open are greater than the forces on the control ring due to springs 32, wherein the vapor pressure forces maintain the control ring in the open position. Valve 40 also includes a second position, preferably wherein conduit 38 is fully closed thereby and vapor passes into annular recess 28 from diffuser passage 16, for maintaining a high pressure in the annular recess wherein springs 32 maintain control ring 30 in the throttling position.

Valve 40 is operated by positioning means 41, which may be of any appropriate type such as electric, pneumatic, or hydraulic positioners. Positioning means 41 is responsive to an operating condition of the compressor or its associated equipment which is indicative of the load on the compressor. Thus, if the compressor were to be used in a refrigeration machine, then the positioning means could be responsive to the temperature of the chilled water leaving the machine, this temperature being related to the quantity of refrigerant being lifted from the low side to the high side of the machine by the compressor. If the compressor were being used to compress air, then the positioning means could be responsive to ambient temperature, since this is an indication of the air density and therefore the quantity of air being compressed. Preferably, though, the position of valve 40 is determined by the position of guide vanes 24, sensed by sensing means 43. Sensing means 43 may include, for example, a limit switch (not shown) which is actuated by a guide vane or a control linkage thereof in response to movement of the guide vane to a predetermined position, indicative of a restricted flow of vapor through compressor 10.

Compressor 10, with diffuser control 26 described above, functions as follows. With valve 40 in the first position wherein conduit 38 is open, annular recess 28 is in communication, via conduit 38, with the low pressure source, and the pressure in the recess is approximately equal to that of the low pressure source. Vapor pressure in annular recess 28 is less than vapor pressure in diffuser passage 16 and a pressure difference exists across control ring 30, urging the control ring rearward, to the left as viewed in the drawing. As mentioned above, the low pressure source is chosen so that the forces on control ring 30 resulting from the pressure differential thereacross when conduit 38 is open are greater than the forces on the control ring due to springs 32. Thus, control ring 30 is moved to and maintained in the open position, allowing maximum vapor flow through diffuser passage 16.

Second stop means 42 may be provided to limit rearward movement of control ring 30, and preferably the second stop means includes a surface of housing 12. More specifically, as control ring 30 moves rearward and reaches the open position, flange 44 of the control ring abuttingly engages surface 42 and this abutting engagement prevents further rearward movement of the control ring. With this arrangement, flange 44 and surface 42, when abuttingly engaged as described above, also function as sealing means for retarding vapor flow from the higher pressure, right side of control ring 30 to the lower pressure, left side thereof.

To move control ring 30 to the throttling position, valve 40 is moved to the second position, preferably wherein conduit 38 is fully closed by the valve. This may be done, as mentioned above, in response to any one of a number of conditions indicative of a restricted flow rate through compressor 10 such as the position of guide vanes 24. With conduit 38 closed, annular recess 28 is isolated from the low pressure source. Vapor passes into annular recess 28 from diffuser passage 16 through the interface between surface 42 and flange 44, equalizing the pressure in the annular recess and the diffuser passage. The vapor pressure forces on control ring 30 equalize. Forces from springs 32 dominate and push control ring 30 into diffuser passage 16 to the throttling position, wherein abutting contact between flange 36 and surface 34 prevents further forward movement of the control ring. In the throttling position, control ring 30 throttles refrigerant passing into diffuser passage 16, maintaining stable vapor flow therethrough at the relatively lower flow rate.

The two positions of control ring 30 provide stable vapor flow through diffuser passage 16 over a wide range of compressor loads. At the same time, diffuser control 26, since it does not require the complex mechanical or pneumatic components of prior art diffuser ring controls, is relatively simple to construct and install. This substantially reduces the cost and improves the reliability of the diffuser control, and facilitates manufacture and installation thereof. Furthermore, the simplicity of diffuser control 26, particularly the absence of any complicated mechanical linking arrangement connecting the control with, for example, guide vanes 24, makes the diffuser control well suited for use on a retrofit basis.

While it is apparent that the invention herein disclosed is well calculated to fulfill the objects above stated, it will be appreciated that numerous modifications and embodiments may be devised by those skilled in the art, and it is intended that the appended claims cover all such modifications and embodiments as fall within the true spirit and scope of the present invention.

What is claimed is:

1. A diffuser control for controlling vapor flow through a diffuser passage comprising:

an annular recess defined by a housing of the diffuser passage and in communication therewith;

diffuser restriction means supported for movement within the recess and the diffuser passage between a throttling position, wherein the restriction means allows a restricted vapor flow through the diffuser passage, and an open position for permitting a substantially free flow of vapor through the diffuser passage, and including a front, radially and annularly extending surface, an outside axial surface extending rearward from an outside radial edge of the front surface and spaced from the housing to facilitate movement of the diffuser restriction means, and an inside axial surface extending rearward from an inside radial edge of the front surface and spaced from the housing to facilitate movement of the diffuser restriction means;

resilient means supported by the housing and urging the restriction means toward the throttling position;

first stop means for limiting movement of the restriction means at the throttling position;

a low pressure conduit for connecting the annular recess to a low pressure source;

sealing means including an outside annular flange located within the annular recess and radially extending outward from the outside axial surface of the diffuser restriction means, an inside annular flange located within the annular recess and radially extending inward from the inside axial surface of the diffuser restriction means, a first annularly extending sealing surface defined by the housing rearward of the outside annular flange, and a second annularly extending sealing surface defined by the housing rearward of the inside annular flange, and wherein when the diffuser restriction means is in the open position, the outside and inside annular flanges abut against the first and second sealing surfaces respectively to limit rearward movement of the diffuser restriction means and to retard vapor flow from the diffuser passage rearward past the diffuser restriction means; and valve means for regulating vapor flow through the low pressure conduit and including a first position for maintaining a low pressure in the annular recess and a pressure difference across the diffuser restriction means for maintaining the restriction means in the open position, and a second position for maintaining a high pressure in the annular recess wherein the urging means maintains the restriction means in the throttling position.

2. A centrifugal vapor compressor comprising:

a housing defining an inlet passage and a diffuser passage;

an impeller rotatably mounted in the housing between the inlet and diffuser thereof;

an annular recess defined by the housing and in communication with the diffuser thereof;

diffuser restriction means supported for movement within the annular recess and the diffuser passage between a throttling position, wherein the restriction means allows a restricted vapor flow through the diffuser passage, and an open position for permitting a substantially free flow of vapor through the diffuser passage, and including a front, radially and annularly extending surface, an outside axial surface extending rearward from an outside radial edge of the front surface and spaced from the housing to facilitate movement of the diffuser restriction means, and an inside axial surface extending rearward from an inside radial edge of the front surface and spaced from the housing to facilitate movement of the diffuser restriction means;

resilient means supported by the housing and urging the restriction means toward the throttling position;

first stop means for limiting movement of the restriction means at the throttling position;

a low pressure conduit for connecting the annular recess to a low pressure source;

sealing means including an outside annular flange located within the annular recess and radially extending outward from the outside axial surface of the diffuser restriction means, an inside annular flange located within the annular recess and radially extending inward from the inside axial surface of the diffuser restriction means, a first annularly extending sealing surface defined by the housing rearward of the outside annular flange, and a second annularly extending sealing surface defined by the housing rearward of the inside annular flange, and wherein when the diffuser restriction means is in the open position, the outside and inside annular flanges abut against the first and second sealing surfaces respectively to limit rearward movement of the diffuser restriction means and to retard vapor flow from the diffuser passage rearward past the diffuser restriction means; and valve means for regulating the vapor flow through the low pressure conduit and including a first position for maintaining a low pressure in the annular recess and a pressure difference across the diffuser restriction means for maintaining the restriction means in the open position, and a second position for maintaining a high pressure in the annular recess wherein the urging means maintains the restriction means in the throttling position.

3. The invention as defined by claims 1 or 2 wherein the first stop means includes a third annularly extending surface defined by the housing forward of the outside annular flange; and when the diffuser restriction means is in the throttling position, the outside annular flange abuts against the third surface to limit forward movement of the diffuser restriction means.

4. The invention as defined by claim 3 wherein:

when the valve means is in the first position, the low pressure conduit is open; and when the valve means is in the second position, the low pressure conduit is closed thereby.

5. The invention as defined by claim 4 wherein the resilient means includes a plurality of springs.

6. The invention as defined by claim 2 wherein the low pressure source is an inlet line to the compressor.

7. The invention as defined by claim 6 wherein the position of the valve means is determined by the position of an inlet guide vane of the compressor.

* * * * *